US008679257B2

(12) United States Patent
Steiner et al.

(10) Patent No.: US 8,679,257 B2
(45) Date of Patent: Mar. 25, 2014

(54) METHOD FOR ADDING A MULTI-COMPONENT DETERGENT ADDITIVE IN A WATER LEADING HOUSEHOLD APPLIANCE

(75) Inventors: Winfried Steiner, Nürnberg (DE); Rolf Stahlmann, Wolframs-Eschenbach (DE); Christian Daume, Burgthann (DE); Stefan Füglein, Nürnberg (DE); Klaus-Martin Forst, Zirndorf (DE); Guiseppe Marone, Nichelino (IT); Paolo DaPont, Turin (IT)

(73) Assignees: Electrolux Home Products Corporation N.V., Zaventem (BE); ELBI International S.p.A., Collegno (IT)

( * ) Notice: Subject to any disclaimer, the term of this patent is extended or adjusted under 35 U.S.C. 154(b) by 1054 days.

(21) Appl. No.: 11/577,744

(22) PCT Filed: Oct. 22, 2005

(86) PCT No.: PCT/EP2005/011368

§ 371 (c)(1),
(2), (4) Date: May 20, 2008

(87) PCT Pub. No.: WO2006/045563

PCT Pub. Date: May 4, 2006

(65) Prior Publication Data

US 2008/0283091 A1 Nov. 20, 2008

(30) Foreign Application Priority Data

Oct. 29, 2004 (EP) ..... 04025724

(51) Int. Cl.
*B08B 7/04* (2006.01)
*B08B 3/02* (2006.01)
*B08B 3/04* (2006.01)

(52) U.S. Cl.
USPC ..... 134/18; 134/25.2; 134/26

(58) Field of Classification Search
USPC ..... 134/18, 25.2, 26
See application file for complete search history.

(56) References Cited

U.S. PATENT DOCUMENTS

| | | | | |
|---|---|---|---|---|
| 4,569,781 | A * | 2/1986 | Fernholz et al. | 510/225 |
| 4,808,236 | A | 2/1989 | Davis, Jr. | |
| 6,448,212 | B1 * | 9/2002 | Holderbaum et al. | 510/296 |
| 6,773,668 | B1 * | 8/2004 | Everson et al. | 422/28 |
| 2003/0080162 | A1 | 5/2003 | Hegeman | |
| 2003/0168085 | A1 * | 9/2003 | Sowle et al. | 134/25.2 |
| 2004/0244434 | A1 | 12/2004 | Zucholl | |
| 2005/0126608 | A1 * | 6/2005 | DeWeerd et al. | 134/56 D |

FOREIGN PATENT DOCUMENTS

| | | |
|---|---|---|
| DE | 3623027 | 1/1988 |
| DE | 102 20 839 | 12/2003 |
| DE | 203 11 433 | 1/2004 |
| EP | 0 725 182 | 8/1996 |
| EP | 1 002 494 | 5/2000 |
| EP | 1 245 180 | 10/2002 |
| EP | 1 319 360 | 6/2003 |
| GB | 1 521 760 | 4/2007 |

OTHER PUBLICATIONS

Machine translation of foreign patent document DE 10220839, Ennen et al., Dec. 2003.*
International Search Report (Application #: PCT/EP2005/011368) dated Oct. 29, 2004.
European Search Report (Application #: EP 04 02 5724 dated May 13, 2005.
Russian Office Action for 2007119714/12(021492) dated Aug. 14, 2009, 5 pages.

* cited by examiner

*Primary Examiner* — Michael Kornakov
*Assistant Examiner* — Natasha Campbell
(74) *Attorney, Agent, or Firm* — Pearne & Gordon LLP

(57) ABSTRACT

The invention relates to a method for adding a multi-component solid detergent additive during a program sequence of a water leading household appliance, in particular a dishwasher, wherein the household appliance comprises a compartment for storing the detergent additive. According to the invention, the liquid supply to the detergent additive stored in the compartment is effected in dependency of the program sequence, wherein in particular the liquid supply to the compartment is repeated at different times. Similarly a household appliance is provided with a device for adding a multi-component detergent additive.

14 Claims, 2 Drawing Sheets

Figure 1A:
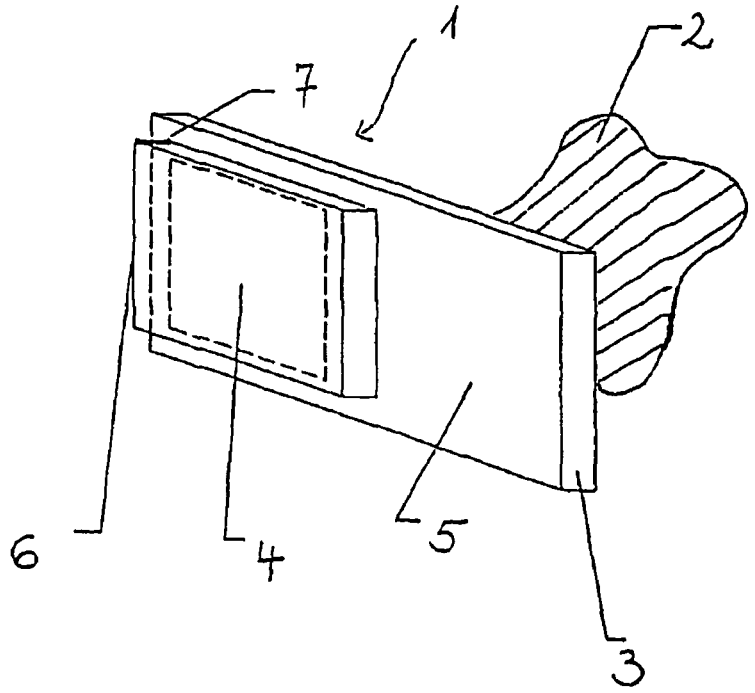

METHOD FOR ADDING A MULTI-COMPONENT DETERGENT ADDITIVE IN A WATER LEADING HOUSEHOLD APPLIANCE

The invention relates to a method for adding or supplying a multi-component solid detergent additive to the cleaning process during a program sequence of a water leading household appliance, in particular a dishwasher, as well as a water leading household appliance having a device for using a multi-component detergent additive.

The suppliers of dishwasher detergents offer so-called three-in-one or two-in-one detergent tablets being composed of several detergent additives as multi-component-type to be used in dishwashers. Composed for example of a detergent for the main wash, a water softener for softening the water and a rinse aid for rinsing the dishes loaded in the dishwasher for washing. According to the requirements, the manufacturers of household appliances offer dishwashers having a selectable program cycle, in which by means of pressing buttons the adding of softeners or rinse aid from separate dosing devices is blocked. Before starting the program cycle the multi-component detergent tablet is for example placed in the cutlery basket or in the dosing device being generally used for the main wash detergent. Thus the detergent tablet is exposed to the circulating washing liquid from the beginning of the program sequence and the particular components of the detergent tablet dissolve more or less defined during the different phases of the program sequence (pre-wash/main wash/clear rinsing). In each case the detergent tablet is subject to conditions being difficult to control, such as a mechanical movement due to flow change or turbulences and high differences in the provided amount of washing liquid, for example, if the tablet is covered by dishes and is not directly exposed to a spray jet of a spray arm. This can cause heavy delay effects between the individual cleaning phases, for example the rinse aid is already dissolved during the main wash or the main wash detergent is only completely dissolved during the rinsing. Correspondingly, the results of the particular program sections can not be optimal.

It is an object of the invention to provide a method for adding a multi-component solid detergent additive in the cleaning process of a household appliance, as well as a household appliance in which the adding of the detergent additives results in an optimized cleaning.

This object is solved by means of the features of claims 1 and 13, respectively. Preferred embodiments are subject matter of the dependent claims.

Dissolving particular components of a multi-component solid detergent additive is substantially dependent on the reaction time of a dissolving liquid, its temperature and the mechanic effect of liquid upon detergent additives. The solid detergent additives in the multi-component solid detergent additive may be provided e.g. as tablets (compressed powder) or loose powder, in which the components of the detergent additive are mixed up with each other.

According to claim 1, dissolving detergent additives is not carried out directly in the cleaning region of the household appliance, for example in the washing compartment of a dishwasher or in the washing drum of a washing machine, but in a separate compartment of the household appliance to which liquid for dissolving detergent additives or detergent additive components may be controllably fed. This also means that a liquid supply to the separate compartment is at least partially effected independent of the time (and amount) of liquid distribution in a cleaning compartment (e.g. leaching or washing compartment) of a household appliance. The compartment is for example a pull-out drawer for storing detergent additives, into which via a separate supply pipe liquid is fed and from there drained into the cleaning compartment of the household appliance. Or, for example in a dishwasher, it is a dosing device having a compartment adjacent to the cleaning compartment, the cover of which may be opened and closed in a time-controlled manner.

If the household appliance is for example a washing machine, the detergent additives may contain detergents for the main wash, bleaching agents, softeners and fabric softeners. Also those dissolve in dependency of the liquid reaction time, the liquid amount and the liquid temperature, so that the detergent for the main wash is preferentially dissolved during this time, while for example a fabric softener dissolves only very slowly in order to be fed then during the fabric softening process.

The detergent additives stored in the compartment are not permanently provided with liquid during the program sequence but for predefined times and during a predefined period of time only, so that the dissolving of detergent additives is systematically effected at desired points of time during the individual program sections. Thus, dissolving is carried out under predefined reproducible conditions, wherein in the compartment already the complete dissolving of the detergent additive component or at least the rough dissolving is carried out, followed by a complete dissolving in the actual cleaning cycle. For optimal dissolving, the reaction times, the fed liquid amount and/or the temperature are again optimized dependent on the used detergent additives. Those are for example known from the information given by the detergent manufacturer and may be considered dependent on the detergent type as regards the control of liquid supply to the compartment.

In a dishwasher for example, after the pre-wash, a first liquid supply is carried out during the main wash, so that the detergent is dissolved for the main wash. A further supply of liquid is then carried out just before or during the clear rinsing, in which then the clear rinse aid component of the detergent additive is dissolved and added for the clear rinsing.

The liquid supplied into the compartment is fresh water of the fresh water supply of the appliance, or is preferentially the cleaning liquid already used in the household appliance, from which a part is branched off and fed into the compartment. This cleaning liquid is preferentially provided from the circulating cycle of the household appliance, for example in a dishwasher from the washing liquid fed to a top shower or an upper spray arm. In this case the liquid supply into the compartment may only be carried out, if the liquid is circulated in the circulating cycle, however, the supply within the possibly existing intervals of the liquid circulating cycle in the household appliance is in turn not permanently carried out during the entire circulating intervals but in controlled time intervals only.

Since the dissolving of the particular detergent additives components is also highly dependent on temperature, the supply of the liquid taken from the cleaning liquid of the household appliance is preferentially carried out only, if this has a predefined temperature or a temperature in a predefined range. For clear rinsing in a dishwasher for example a very high temperature of the circulated liquid is set, which is then supplied in a controlled manner into the compartment for dissolving the otherwise heavily dissolvable clear rinse aid component of the detergent additive.

The user of the household appliance may preferably input different program options by means of an input device, for example, whether a three-in-one detergent additive, a two-in-one detergent additive or conventionally only a detergent for the main program section is stored in the compartment. By means of this also several types of detergent additives may be inputted, so that the household appliance control unit controls the optimal points of time, periods of time and/or temperatures of the liquid supply into the compartment.

In the household appliance according to claim 20 a closing device arranged over an opening between a cleaning compartment and a compartment for storing a detergent for the liquid in the appliance is operable by means of an actuator, so that the opening may be completely or partially closed or opened. Embodiments are described above and as follows.

Figure 1B:
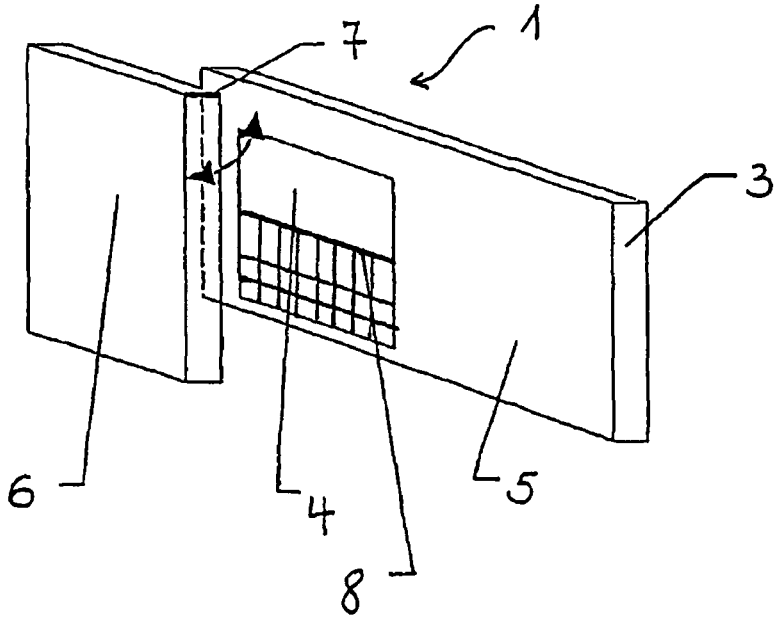
Figure 2:
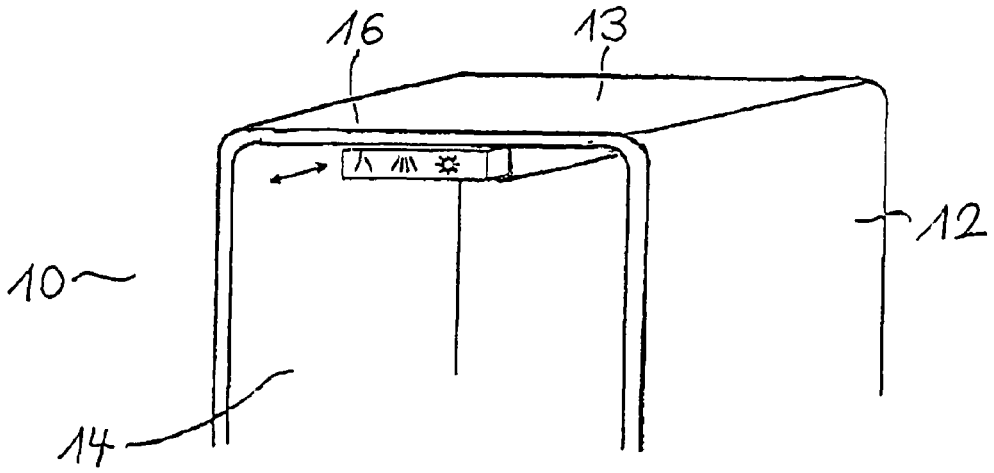
Figure 3A:
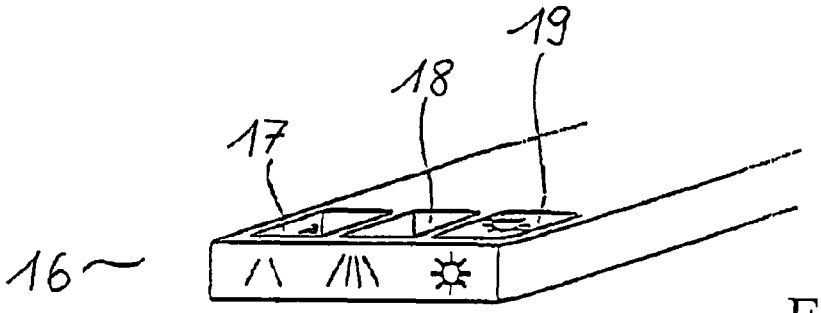
Figure 3B:
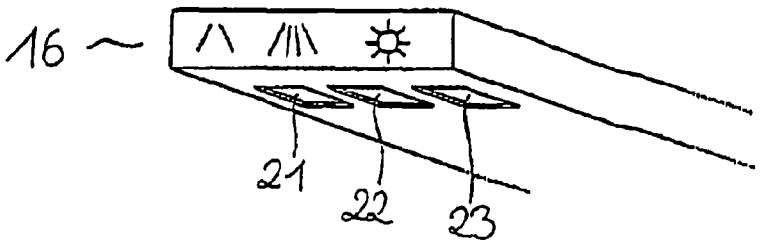

The embodiments of the invention are explained in detail by means of drawings which show:

FIGS. 1A and 1B a schematical view of a dosing device having a cover supported for pivoting an angle of 90°, FIG. 2 a further preferred embodiment of a dispensing unit according to the invention, and FIGS. 3A and 3B detailed perspective views of the dispensing unit according to FIG. 2.

FIGS. 1A and 1B show a schematic perspective view of a first dosing combination device 1 being mounted with its inner panel 3 onto an inner wall 2 of the loading door of a dishwasher. The dosing combination device 1 comprises a compartment 4 for solid detergent and a liquid dosing apparatus 5 (not further shown in detail herein) being arranged adjacent to the compartment 4.

In the dosing combination device 1 shown in FIGS. 1A and 1B a cover 6 for closing and opening the compartment 4 is supported at a shaft 7 being guided through the front side of the inner panel 3 to the inside of the loading door and being supported therein. Cover 6 and shaft 7 are fixedly connected to each other in this embodiment and may be formed as one-piece for example. The cover 6 is pivotable by an angle of 90° around its pivoting point (shaft 7), as illustrated in FIG. 1B by means of the double arrow. In the closed position (FIG. 1A) the cover 6 covers the opening of the compartment 4 so that in this position no washing liquid gets to the detergent stored in the compartment 4.

In the opened position (FIG. 1B) the cover releases the compartment so that the detergent stored in the compartment is provided with washing liquid. The pivoting movement of the cover 6 is parallel to the front side of the inner panel 3 and also parallel to the region of the inner wall 2 being adjacent to the device 1. A grille 8 or net is arranged at the lower portion of the compartment opening and prevents a detergent tablet or bigger parts of a partially dissolved detergent tablet to fall out when closing the loading door or while opening the cover 6. The opening of the compartment 4, which is not covered by the grille 8; is big enough to easily fill a detergent tablet or pearls thereinto.

The program cycle control of the dishwasher controls a motor (not shown) connected to the shaft 7, such that at predefined times of the program sections the cover 6 is completely or partially pivoted sideways and the compartment 4 including the detergent tablet stored therein is exposed. After the opening the motor moves the cover back into the closed position. The liquid amount entering into the opening 4 may be adjusted by means of the partial opening degree.

FIG. 2 shows a further preferred embodiment for storing and adding detergents in a dishwasher. At a side wall 12 or a top wall 13 inside the washing compartment 10 of the dishwasher a dispensing unit 16 is arranged as a drawer-like pull-out tray. When the dishwasher door (not shown) is opened and the loading opening 14 is released, the output unit 16 can be pulled out so that the feed openings 17, 18 and 19 to be loaded with detergent are opened, as shown in FIG. 3A. Under conventional use, i.e. when filling the dishwasher with separate single components, a pre-wash detergent is filled into the feed opening 17, a main wash detergent is filled into the feed opening 18 and a clear rinse aid is filled into the feed opening 19. Via a liquid supply system not shown herein liquid is supplied into the openings 17, 18 or 19 in dependency of the program section. For example at the beginning of the main wash liquid is supplied to opening 18 and at the beginning of the clear rinsing liquid is supplied to opening 19 so that the desired detergent for the corresponding program section is available. As shown in FIG. 3B the liquid mixed with the corresponding detergent flows out of the dispensing openings 21, 22, 23 corresponding to the feed openings 17, 18 and 19 into the washing compartment 10.

When using a dosing device according to the arrangement in FIGS. 1A and 1B as well as in the dosing device according to the arrangement of FIGS. 3A and 3B the dishwasher comprises an input unit where by means of a special button it is indicated whether, instead of single components to be separately filled, a combination detergent having two or more components each for a different phase of the program cycle or sequence is used by the user. In FIGS. 1A and 1B the combination detergent is filled into the opening or receptacle 4 in the form of a detergent tablet or a very coarse detergent powder (pearls), while in the embodiment according to FIG. 3A this is for example filled into the compartment 18 for the main wash. In the embodiment according to FIGS. 3A and 3B the liquid supply into one of the other compartments 17 or 19 is then interrupted after selecting this program option (multi-component detergent) depending on which of the detergents (pre-wash detergent, clear rinse aid) is already contained as a component in the multi-component detergent. Correspondingly, also the program sequence control is modified such that, if the combination detergent contains a pre-wash detergent, the liquid is not supplied into compartment 17 but into compartment 18. If the combination detergent contains also a clear rinse aid component, the clear rinse aid is not fed from compartment 19 but the liquid is only supplied to compartment 18 in order to dissolve and wash out the clear rinse aid component there.

In the dispensing unit 16 the liquid supplied to the openings 17, 18 19 or compartments is preferentially branched off the circulating cycle feeding herein washing liquid for example to a top shower or an upper spray arm. A corresponding valve for controlled interruption or feeding of liquid to one of the compartments 17, 18, 19 is respectively provided.

Below a control process for adding detergents during the corresponding program or cleaning section is described as an example, in which a so-called three-in-one tablet including a pre-wash detergent, a main wash detergent and a clear rinse aid is used. To all three phases a softener is added so that this in combination with a corresponding detergent of one of the other three phases is dissolved and added to the washing liquid. The user of the dishwasher deposits such a three-in-one tablet in the compartment 4 (FIG. 1B) or the feed opening 18, loads the dishwasher with dishes, closes the dishwasher and inputs at the control panel the menu item 'three-in-one tablet' or selects a corresponding button. In this case neither a pre-wash detergent (feed opening 17), a softener solution from a regeneration unit (not shown) or a clear rinse aid from the feed opening 19 or the liquid dosing apparatus 5 have to be added.

All detergent components are successively dissolved from the multi-component tablet stored in the compartment 4 or in the feed opening 18. The pre-wash detergent is for example arranged on the outside of the multi-component tablet and dissolves already after a short period of time when provided with cold liquid. For this for example the cold washing liquid is supplied for three minutes through the feed opening 18 or the cover 6 is completely opened so that during the pre-wash and the running spray arm the washing liquid pours into the compartment 4 and dissolves there the outer layer of the multi-component tablet. Then the cover 6 is closed or the liquid supply to the feed opening 18 is interrupted, so that the dissolving process of the multi-component tablet is interrupted. Thus the detergent is available for pre-wash.

After termination of pre-wash the washing liquid in turn is supplied to the feed opening 18 after heating the washing liquid circulated within the dishwasher to a medium temperature of about 30° C., or the cover 6 of the compartment 4 is opened for about five minutes. In this period the cover 6 is thereby opened only partially or the liquid flow through the feed opening 18 is reduced, so that there is no mechanic stress onto the detergent tablet and advanced dissolving of the clear rinse aid is prevented. After these five minutes the partially opened cover 6 is closed again or the liquid supply to the feed opening 18 is interrupted. Thus the main wash detergent is available for the main wash.

For clear rinsing the washing liquid circulated in the dishwasher is heavily heated, for example to 50° C., and already at the beginning of clear rinsing a portion of the circulated liquid is fed into the feed opening 18 or supplied via the upper spray arm into the compartment 4 with the cover 6 being opened. This is continued during the entire liquid circulation of clear rinsing, so that the compartment 4 is completely washed or clear rinsing liquid from the circulation cycle is continuously fed into the feed opening 18, so that the compartments 8, 18 are completely cleared from detergent and cleaned.

For example, as a modification of the program cycle in such a three component detergent tablet, the opened state during the main wash is correspondingly elongated in time, if no pre-wash is provided, so that during main wash the pre-wash detergent and the main wash detergent dissolve.

REFERENCE NUMERALS

1 dosing combination device
2 inner wall
3 inner panel
4 compartment
5 liquid dosing apparatus
6 cover
7 shaft
8 grille
10 washing compartment
12 side wall
13 top
14 loading opening
16 output unit
17, 18, 19 feed opening
21, 22, 23 dispensing opening

The invention claimed is:

1. Method for adding a multi-component solid detergent additive during a program sequence of a water leading household appliance, wherein the water leading household appliance is a dishwasher, wherein the water leading household appliance comprises one compartment (4,18) adapted to store a multi-component solid detergent additive, wherein a liquid supply to said compartment is effected in dependency of the program sequence, so that the liquid supply is effected repeatedly in time intervals, wherein the water leading household appliance comprises an input device for inputting a program option and the liquid supply is additionally effected in dependency of the selected program option, wherein by means of the input device, a component type of the multi-component solid detergent additive may be selected, and the liquid supply to the compartment is effected only during those program sections of the program sequence for which the selected type contains a corresponding component of the multi-component solid detergent additive, and dissolving each of the corresponding components of the multi-component solid detergent additive during the program section associated with each of the corresponding components, wherein the step of dissolving each of the corresponding components takes place within the one compartment storing the multi-component solid detergent additive.

2. Method according to claim 1, wherein the liquid supply into the compartment (4, 18) is effected during at least two different program sections of the program sequence.

3. Method according to claim 2, wherein the liquid supply duration, the supplied liquid amount and/or the liquid temperature in at least two program sections are different.

4. Method according to claim 1, 2 or 3, wherein the point of time for supplying liquid during a program section is dependent on the program section type.

5. Method according to claim 1, wherein the liquid supplied into the compartment (4, 18) is taken from a fresh water supply of the household appliance and/or a washing liquid or suds being stored in the household appliance.

6. Method according to claim 5, wherein the supplied liquid is branched off a supply pipe to a liquid distributing device of a circulating cycle for the liquid of the household appliance.

7. Method according to claim 5, wherein the household appliance comprises a cleaning compartment, for loading objects to be cleaned and a distributing device for distributing liquid in said cleaning compartment and wherein the liquid being distributed in said cleaning compartment is first supplied into the compartment (4, 18) under temporal control.

8. Method according to claim 7, wherein the compartment (4) is adjacent to the cleaning compartment and wherein an opening or a passage between the compartment (4) and the cleaning compartment may be closed by means of a closing device (6), so that the liquid supply into said compartment is effected by a temporally controlled opening of the closing device.

9. Method according to claim 6, 7 or 8, wherein the household appliance is a dishwasher and the distributing device is a spray arm of the dishwasher.

10. Method according to claim 5, wherein during a program section having a temporally changing liquid temperature, the liquid taken out of the cleaning liquid is supplied into the compartment (4, 18) when a predefined cleaning liquid temperature has been attained.

11. Method according to claim 1, wherein the selected type is indicative of the particular multi-component solid detergent additive that has been placed in the compartment (4).

12. Method according to claim 1, wherein the liquid supply to the compartment is interrupted at a conclusion of one of said program sections during which the liquid supply to the compartment was effected.

13. Method according to claim 12, wherein the compartment is closed at the conclusion of said one of said program sections during which the liquid supply to the compartment was effected.

14. Method for adding a multi-component solid detergent additive during a program sequence of a water leading household appliance, wherein the water leading household appliance is a dishwasher, wherein the water leading household appliance comprises a compartment adapted to store a multi-component solid detergent additive, wherein a liquid supply to said compartment is effected in dependency of the program sequence, so that the liquid supply is effected repeatedly in time intervals, wherein the water leading household appliance comprises an input device for inputting a program option and the liquid supply is additionally effected in dependency of the selected program option, wherein by means of the input device, a type of a particular multi-component solid detergent additive may be selected, and the liquid supply to the compartment is effected only during those program sections of the program sequence for which the selected type contains a corresponding component of the multi-component solid detergent additive;

dissolving each of the corresponding components of the multi-component solid detergent additive during the program section associated with each of the corresponding components, wherein the step of dissolving each of the corresponding components takes place within one compartment storing the multi-component solid detergent additive; and dissolving the entirety of the multi-component solid detergent additive within one dishwasher wash cycle.

* * * * *

UNITED STATES PATENT AND TRADEMARK OFFICE

CERTIFICATE OF CORRECTION

PATENT NO. : 8,679,257 B2
APPLICATION NO. : 11/577744
DATED : March 25, 2014
INVENTOR(S) : Steiner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1581 days.

Signed and Sealed this
Twenty-ninth Day of September, 2015

Michelle K. Lee

Michelle K. Lee
*Director of the United States Patent and Trademark Office*